US010054370B2

(12) United States Patent
Takubo

(10) Patent No.: US 10,054,370 B2
(45) Date of Patent: Aug. 21, 2018

(54) HEAT EXCHANGER

(71) Applicant: Takubo Machine Works Co., Ltd., Hiroshima-ken (JP)

(72) Inventor: Sadao Takubo, Hiroshima-ken (JP)

(73) Assignee: Takubo Machine Works Co., Ltd., Hiroshima-ken (JP)

( * ) Notice: Subject to any disclaimer, the term of this patent is extended or adjusted under 35 U.S.C. 154(b) by 463 days.

(21) Appl. No.: 14/309,056

(22) Filed: Jun. 19, 2014

(65) Prior Publication Data

US 2015/0013952 A1 Jan. 15, 2015

(30) Foreign Application Priority Data

Jul. 11, 2013 (JP) ..... 2013-145627

(51) Int. Cl.
*F28F 9/02* (2006.01)
*F28D 7/02* (2006.01)
(Continued)

(52) U.S. Cl.
CPC ..... *F28D 9/00* (2013.01); *F28D 9/0025* (2013.01); *F28F 3/00* (2013.01); *F28F 2225/04* (2013.01); *F28F 2230/00* (2013.01)

(58) Field of Classification Search
CPC .... F28D 9/0025; F28D 9/0037; F28D 9/0081; F28D 7/16; F28D 9/0075; F28F 3/10; F28F 7/16; F28F 9/0075; Y10T 29/4935
(Continued)

(56) References Cited

U.S. PATENT DOCUMENTS 2,019,351 A 10/1935 Lathrop
2,064,928 A 12/1936 Lewis
(Continued)

FOREIGN PATENT DOCUMENTS

CH 657692 A5 9/1986
CN 2729573 Y 9/2005
(Continued)

OTHER PUBLICATIONS

Japanese communication dated Jul. 8, 2014 in corresponding Japanese patent application No. 2013-145627.
(Continued)

*Primary Examiner* — Jason Thompson
(74) *Attorney, Agent, or Firm* — Nields, Lemack & Frame, LLC

(57) ABSTRACT

The invention provides a heat exchanger, comprising a casing with a structure of a hollow box and a heat transfer unit accommodated in the casing, wherein the heat transfer unit is so arranged that flat plates are alternately folded back in opposite direction along a fold-back line, a first flow passage and a second flow passage are alternately formed in multiple layers between the flat plates, a first opening and a second opening being communicated with the first flow passage are provided on the casing, a third opening and a fourth opening communicated with the second flow passage are provided on the casing, end portions of the flat plates adjacent, as positioned at the end portion of the fold-back line, to the first flow passage and the second flow passage of the heat transfer unit are crushed and adhered, and edges of the end portions are welded together.

1 Claim, 10 Drawing Sheets

(51) Int. Cl.
*F28F 3/00* (2006.01)
*F28D 9/00* (2006.01)

(58) Field of Classification Search
USPC ..... 165/158; 29/890.02, 890.039
See application file for complete search history.

(56) References Cited

U.S. PATENT DOCUMENTS

| | | | | |
|---|---|---|---|---|
| 2,321,110 | A | 6/1943 | Carroll | |
| 2,462,421 | A * | 2/1949 | Pitt | F28D 9/0037 165/166 |
| 3,829,945 | A | 8/1974 | Kanzler et al. | |
| 3,986,549 | A | 10/1976 | Huggins et al. | |
| 4,043,388 | A | 8/1977 | Zebuhr | |
| 4,131,159 | A | 12/1978 | Long | |
| 4,314,607 | A * | 2/1982 | DesChamps | F28D 9/0025 165/166 |
| 4,384,611 | A * | 5/1983 | Fung | F28D 9/0025 165/166 |
| 4,554,719 | A * | 11/1985 | Lewis | B21D 53/04 29/509 |
| 4,776,387 | A | 10/1988 | Newman | |
| 4,848,451 | A | 7/1989 | Jonsson et al. | |
| 4,872,504 | A | 10/1989 | Huebner | |
| 4,887,869 | A | 12/1989 | Nishii et al. | |
| 5,303,771 | A | 4/1994 | Des Champs | |
| 5,494,100 | A | 2/1996 | Peze | |
| 5,823,767 | A | 10/1998 | Watanabe et al. | |
| 6,209,223 | B1 | 4/2001 | Dinh | |
| 6,289,977 | B1 | 9/2001 | Claudel et al. | |
| 6,408,941 | B1 | 6/2002 | Zuo | |
| 6,742,284 | B2 | 6/2004 | Dinh | |
| 6,789,612 | B1 * | 9/2004 | Okamoto | H05K 7/206 165/104.33 |
| 2002/0043359 | A1 * | 4/2002 | Mizutani | H01L 21/4882 165/80.3 |
| 2002/0184936 | A1 * | 12/2002 | Gitlin | B21D 5/00 72/379.2 |
| 2003/0093900 | A1 * | 5/2003 | Huguet | F28D 9/0037 29/890.03 |
| 2004/0206486 | A1 | 10/2004 | Whittenberger | |
| 2005/0229921 | A1 | 10/2005 | Krupp | |
| 2006/0018096 | A1 * | 1/2006 | Chen | H01L 23/3672 361/704 |
| 2006/0060336 | A1 | 3/2006 | Calanni et al. | |
| 2006/0060339 | A1 * | 3/2006 | Matsuzaki | F28D 9/0037 165/166 |
| 2008/0072425 | A1 * | 3/2008 | Whittenberger | B21D 53/02 29/890.03 |
| 2009/0229804 | A1 | 9/2009 | Zebuhr | |
| 2012/0132405 | A1 | 5/2012 | Takubo | |
| 2012/0325445 | A1 * | 12/2012 | Dinulescu | B21D 51/52 165/166 |
| 2013/0160970 | A1 | 6/2013 | Takubo | |

FOREIGN PATENT DOCUMENTS

| | | | |
|---|---|---|---|
| DE | 20309327 | U1 | 9/2003 |
| EP | 1251325 | A2 | 10/2002 |
| EP | 1635131 | A1 | 3/2006 |
| EP | 2047913 | A1 | 4/2009 |
| GB | 243093 | A | 11/1925 |
| JP | 36-21644 | A | 11/1961 |
| JP | 49-80457 | A | 7/1974 |
| JP | 60-37293 | A | 3/1985 |
| JP | 60-80094 | A | 5/1985 |
| JP | 63-116098 | A | 5/1988 |
| JP | 63-135790 | A | 6/1988 |
| JP | 1-106768 | A | 4/1989 |
| JP | 6-506054 | A | 7/1994 |
| JP | 10-154887 | A | 6/1998 |
| JP | 11-248388 | A | 9/1999 |
| JP | 2001-502409 | A | 2/2001 |
| JP | 2005-195191 | A | 7/2005 |
| JP | 2012-117681 | A | 6/2012 |
| JP | 2013-132607 | A | 7/2013 |

OTHER PUBLICATIONS

Notice of Allowance dated Jan. 11, 2016 in co-pending U.S. Appl. No. 13/301,940.

Japanese Communication, with English translation, dated May 1, 2012 in co-pending Japanese Patent Application No. JP 2010-264848.

European Communication completed Jun. 20, 2013 in co-pending European Patent Application No. EP 11009266.5.

Chinese Communication, with English translation, dated Jan. 6, 2014 in co-pending Chinese patent application No. 201110386774.9.

Office Action dated Jul. 3, 2014 in co-pending U.S. Appl. No. 13/301,940.

Office Action dated Jul. 14, 2015 in co-pending U.S. Appl. No. 13/301,940.

European communication dated Nov. 11, 2014 in corresponding European patent application No. 14169687.2.

Final Rejection dated Dec. 22, 2014 in co-pending U.S. Appl. No. 13/301,940.

* cited by examiner

HEAT EXCHANGER

BACKGROUND OF THE INVENTION

The present invention relates to a flat plate type heat exchanger.

Energy-saving is promoted, and there are demands for improving thermal efficiency, for saving electric power by recovering waste heat, and for reducing an amount of fuel consumption.

In order to respond to the demands as described above, efforts are now being made to improve thermal efficiency by incorporating a heat exchanger in a system or to recover a waste heat by installing a heat exchanger on an exhaust gas line.

The present applicant proposed a heat exchanger as disclosed in the Japanese Patent Publication JP-A-2012-117631. According to the heat exchanger disclosed in the patent publication, projections are formed on a flat plate at a distribution ratio as required, and the flat plate is folded, back in multilayers alternately with such width as required, and a gap for she projection is formed between the flat plates, and heat transfer unit is arranged with the flat plates as boundaries. A high temperature fluid and a low temperature fluid are passed through the gap, and heat exchange is carried out via the heat transfer unit.

The heat exchanger is advantageous in that the heat exchanger as designed in simple construction and available at low cost, and that the heat exchanger has high thermal efficiency and is convenient in its maintainability. Meanwhile, the heat exchanger as described above did not have high air-tightness and high pressure-tightness to the fluid, which is the object of heat exchange.

SUMMARY OF THE INVENTION

It is an object of the present invention to provide a flat plate type heat exchanger, which is simple in construction and has high air-tightness and pressure-tightness, and which can cope with the use in various operating conditions.

To attain the above object, a heat exchanger according to the present invention comprises a casing with a structure of a hollow box and a heat transfer unit accommodated in the casing, wherein the heat transfer unit is so arranged that flat plates are alternately folded back in opposite direction along a fold-back line, a first flow passage and a second flow passage are alternately formed in multiple layers between the flat plates, a first opening and a second opening being communicated with the first flow passage are provided on the casing, a third opening and a fourth opening communicated with the second flow passage are provided on the casing, end portions of the flat plates adjacent, as positioned at the end portion of the fold-back line, to the first flow passage and the second flow passage of the heat transfer unit are crushed and adhered, and edges of the end portions are welded together.

Further, in the heat exchanger according to the present invention, one end of the first flow passage and the other end of the second flow passage are alternately crushed and are adhered together.

Further, in the heat exchanger according to the present invention, both ends of one of the first flow passage and the second flow passage are crushed and are adhered together.

Further, the heat exchanger according to the present invention further comprises an edge sealing hardware, wherein the edge sealing hardware is prepared in form of a comb to match the second flow passage and claw pieces folded in two are provided, a folded part of the flat plate where the second flow passage is formed by crushing of the end portion is prepared in rectangular form, the claw pieces are engaged with the fold-back portion of the second flow passage and the edge sealing hardware is attached to the end portion, and the edge sealing hardware and edge of the end portion are welded together.

Further, the heat exchanger according to the present invention further comprises a ridge-line sealing hardware band-like and folded in two, wherein the ridge-line sealing hardware is attached over total length of the end portion, and the ridge-line sealing hardware and the end portion are welded together.

Furthermore, in the heat exchanger according to the present invention, a groove is formed on the sealing hardware and is folded in two at the groove, and the groove is welded with end portion by laser welding.

According so the present invention, the heat exchanger comprises a casing with a structure of a hollow box and a heat transfer unit accommodated in the casing, wherein the heat transfer unit is so arranged that flat plates are alternately folded back in opposite direction along a fold-back line, a first flow passage and a second flow passage are alternately formed in multiple layers between the flat plates, a first opening and a second opening being communicated with the first flow passage are provided on the casing, a third opening and a fourth opening communicated with the second flow passage are provided on the casing, end portions of the flat plates adjacent, as positioned at the end portion of the fold-back line, to the first flow passage and the second flow passage of the heat transfer unit are crushed and adhered, and edges of the end portions are welded together. As a result, the heat transfer unit can be configured simply, and further, separation of the first flow passage and the second flow passage can be provided in a reliable manner.

Further, according to the present invention, the heat exchanger further comprises an edge sealing hardware, wherein the edge sealing hardware is prepared in form of a comb to match the second flow passage and claw pieces folded in two are provided, a folded part of the flat plate where the second flow passage is formed by crushing of the end portion is prepared in rectangular form, the claw pieces are engaged with the fold-back portion of the second flow passage and the edge sealing hardware is attached to the end portion, and the edge sealing hardware and edge of the end portion are welded together. As a result, it possible to seal the gap between the ends in reliable manner. Further, the edge sealing hardware fulfills the function as a jig for maintaining the shape of the heat transfer unit, and the edge sealing hardware contributes to the improvement of working efficiency of welding operation.

Further, according to the present invention, the heat exchanger further comprises a ridge-line sealing hardware band-like and folded in two, wherein the ridge-line sealing hardware is attached over total length of the end portion, and the ridge-line sealing hardware and the end portion are welded together. As a result, it possible to seal the gap between the ends in a reliable manner. Further, the ridge-line sealing hardware fulfills the function as a jig for maintaining the shape of the heat transfer unit, and the ridge-line sealing hardware contributes to the improvement of working efficiency of welding operation.

Furthermore, according to the present invention, in the heat exchanger, a groove is formed on the sealing hardware and is folded in two at the groove, and the groove is welded with end portion by laser welding. As a result, it possible to ensure reliable welding between the sealing hardware and the end portion.

DETAILED DESCRIPTION OF THE PREFERRED EMBODIMENTS

Figure 1:
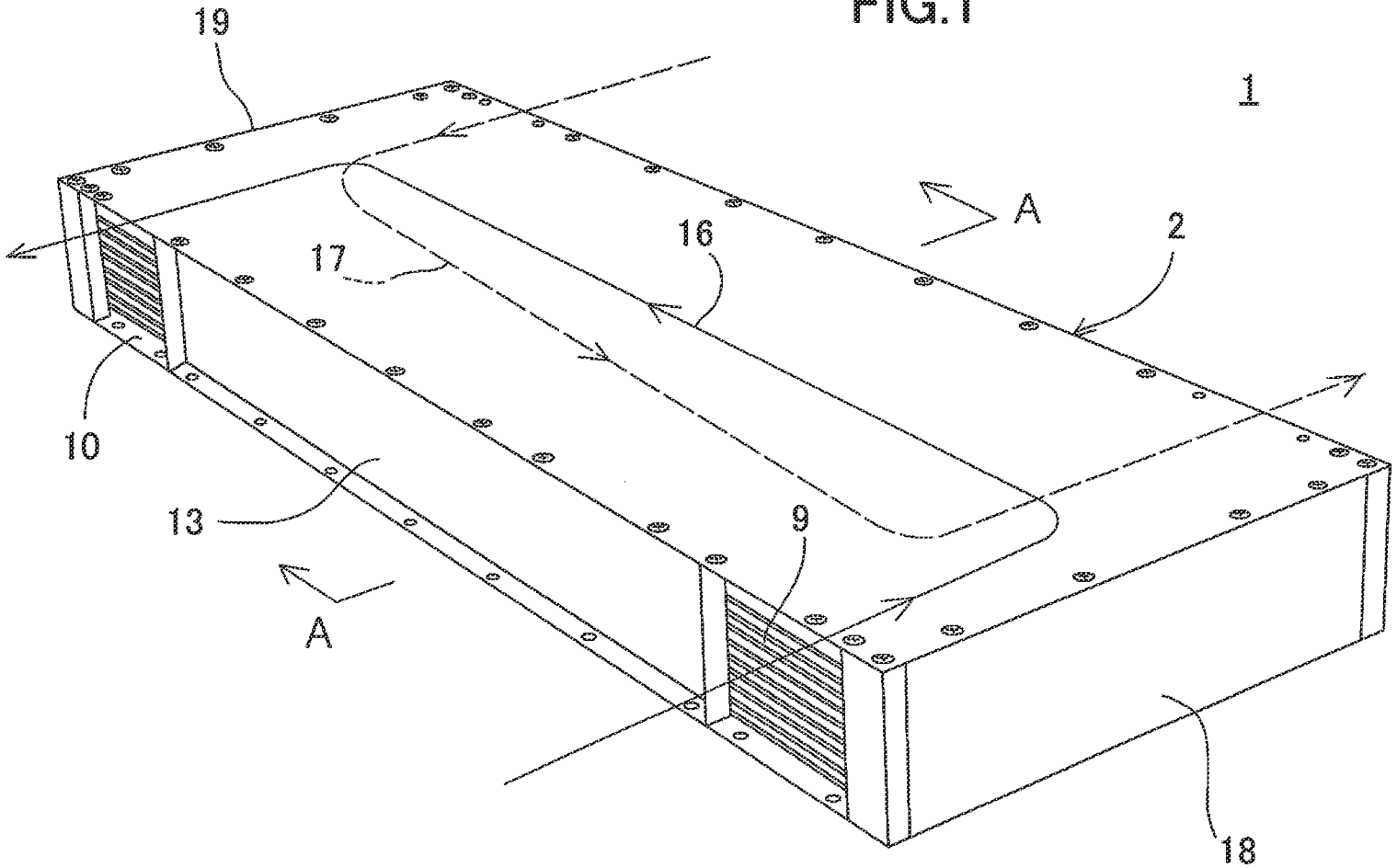
FIG. 1 is a perspective view of a heat exchanger according to an embodiment of the present invention.

Description will be given below on embodiments of the present invention by referring to the drawings.

First, in referring to FIG. 1 and FIG. 2, description will be given on a heat exchanger, which is an embodiment of the present invention.

A heat exchanger 1 comprises a casing 2 with a structure of a hollow box and a heat transfer unit 3 accommodated in the casing 2.

Figure 2:
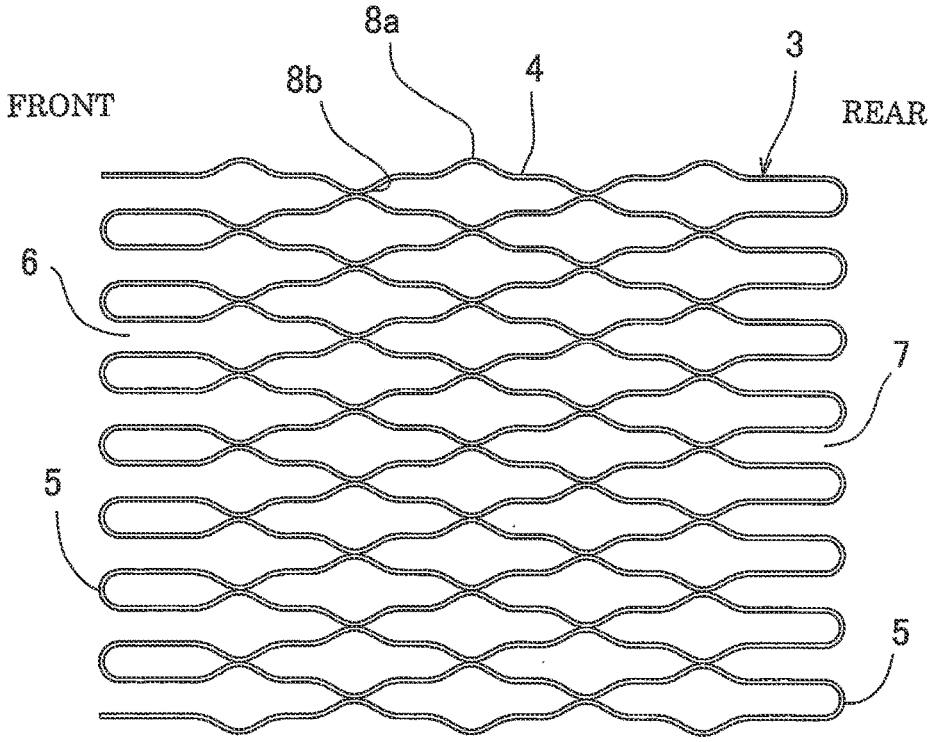
FIG. 2 shows a cross-section of a heat transfer unit used in the heat exchanger, and is an equivalent arrow diagram along a line A-A in FIG. 1.

FIG. 2 represents the heat transfer unit 3. The heat transfer unit 3 comprises a flat plate 4 made of a material with high thermal conductivity such as aluminum by folding the flat plate 4 alternatively on each other in zigzag manner so as to be a multilayer plate. Fold-back lines 5 of the flat plate 4 are designed to be included in the same flat plane. A first flow passage 6 and a second flow passage 7 are arranged alternatively, being separated from each other with the flat plate 4 as a boundary, and are designed to be in multi-laver construction.

In the flat plate 4, projections 8*a* and 8*b* are formed by presswork at a distribution as required. The projection 8*a* and the projection 8*b* are alternately formed in two planar directions respectively (on a front surface and on a back surface of the flat plate 4). Under the condition that the flat plate 4 is folded back, the projection 8*a* is protruded on upper surface of the flat plate 4 and the projection 8*b* is protruded on lower surface so that the projection 8*a* and the projection 8*b* are brought face-to-face to each other.

It is so arranged that gaps necessary for the first flow passage 6 and the second flow passage 7 are formed by the projections 8*a* and 8*b*.

Figure 3:
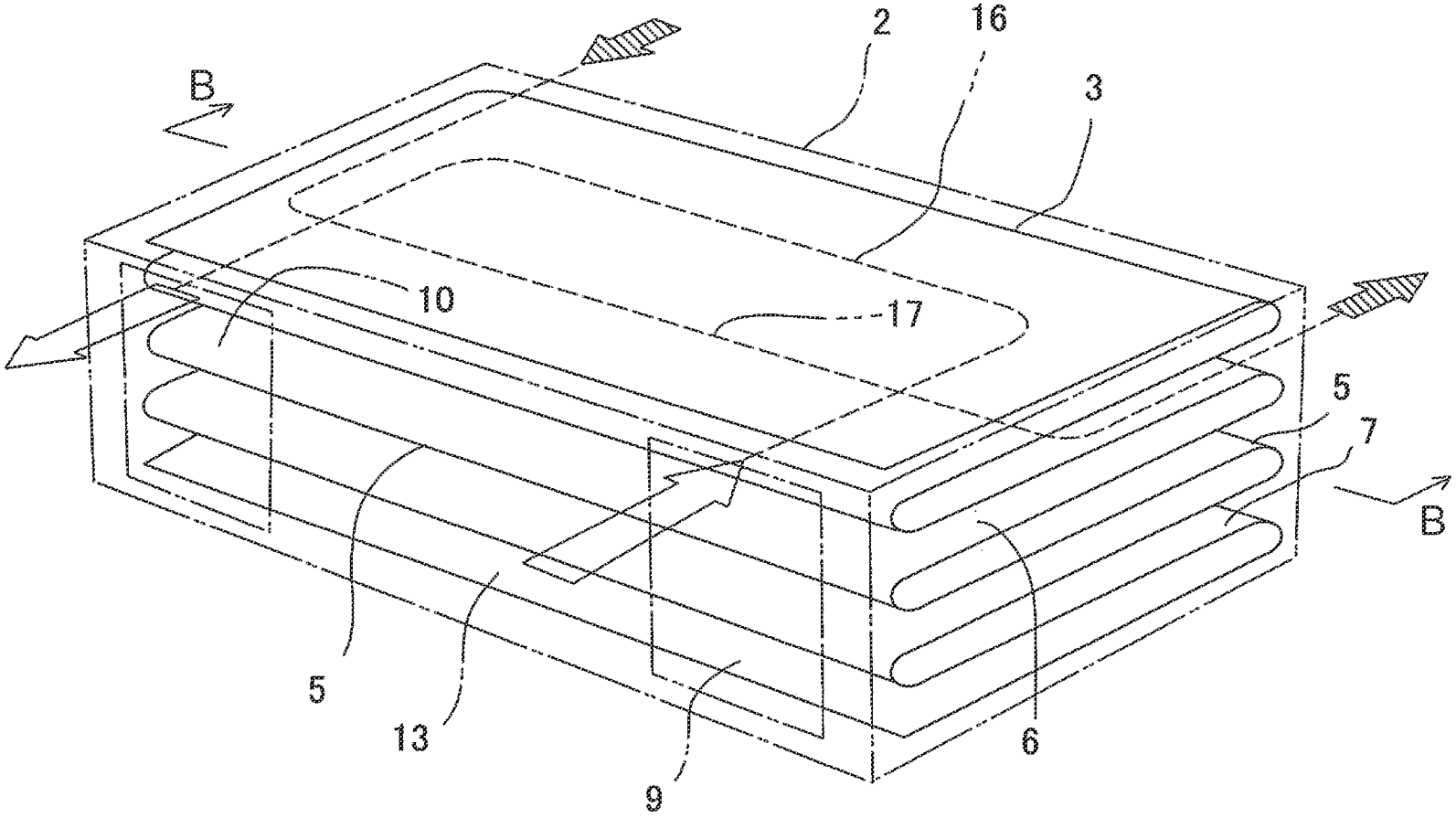
FIG. 3 is an explanatory drawing to show a condition where the heat transfer unit is accommodated in a casing and a condition where a fluid for the heat exchange flows.

FIG. 3 schematically shows a condition where the heat transfer unit 3 is accommodated in the casing 2.

On each of a front wall surface 13 and a rear wall surface 14 (not shown) being in contact with the fold-back line 5, there are provided a first opening 9, a second opening 10, a third opening 11 (not shown) and a fourth opening 12 (not shown).

The first opening 9 and the second opening 10 are provided on both end portions of the front wall surface 13 respectively and are communicated with the first flow passage 6. The third opening 11 and the fourth opening 12 are provided on both end portions of the rear wall surface 14 respectively and are communicated with the second flow passage 7.

A first fluid, e.g. a high temperature fluid 16, enters via the first opening 9 and flows out via the second opening 10. A second fluid, e.g. a low temperature fluid 17, enters via the third opening 11 and flows out via the fourth opening 12. Here, the high temperature fluid. 16 is an exhaust gas generated when oil, gas, etc. are burnt, and the low temperature fluid 17 is the air or the like at ordinary temperature. Low temperature fluid may be used as the first fluid, and high temperature fluid may be used as the second fluid.

When the high temperature fluid. 16 and the low temperature fluid 17 flow through the first flow passage 6 and the second flow passage 7 respectively, a heat is given or taken via the heat transfer unit 3.

As seen in FIG. 3, under the condition that the flat plate 4 is folded back alternately in zigzag manner and the first flow passage 6 and the second flow passage 7 are formed, the first flow passage 6 and the second flow passage 7 are opened at the left end and at the right end respectively. By sealing the left end and the right end of the first flow passage 6 and the second flow passage 7 respectively, the first flow passage 6 and the second flow passage 7 are perfectly separated from each other.

As a structure to seal the left end and the right end of the first flow passage 6 and the second flow passage 7 respectively, the following structure can be conceived: a right lateral place 18 and a left lateral plate 19 are pressed on the heat transfer unit 3 via a sealing member (not shown), and left end the right end are sealed by the right lateral plate 18 and the left lateral plate 19 (as disclosed in the Japanese Patent Publication JP-A-2012-117681). In the sealing structure as described below, air-tightness and pressure-tightness are improved further.

Figure 4:
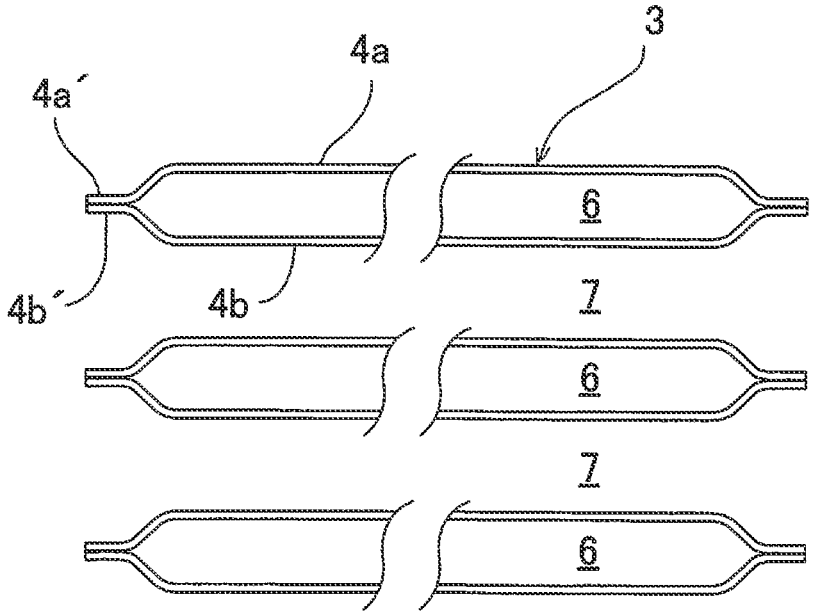
FIG. 4 shows a cross-section of the heat transfer unit according to the embodiment of the present invention, and is an equivalent arrow diagram along a line B-B in FIG. 3.

FIG. 4 partially shows the heat transfer unit 3 according to the present embodiment, and is an arrow diagram along the line B-B in FIG. 3. To facilitate the explanation, the projections 8*a* and 8*b* are not shown.

A flow passage of one of the first flow passage 6 and the second flow passage 7 of the heat transfer unit 3 (the first flow passage 6), i.e. both end portions of flat plates 4*a* and 4*b* adjacent to the first flow passage 6 in the figure, are crushed, and both end portions 4*a*' and 4*b*' are adhered to each other and the passages are air-tightly sealed.

In order to make both end portions of the flat places 4*a* and 4*b* to have the air-tight structure, an edge sealing hardware 21 (see FIG. 5) and a ridge-line sealing hardware 22 (see FIG. 5) are used.

Figure 5:
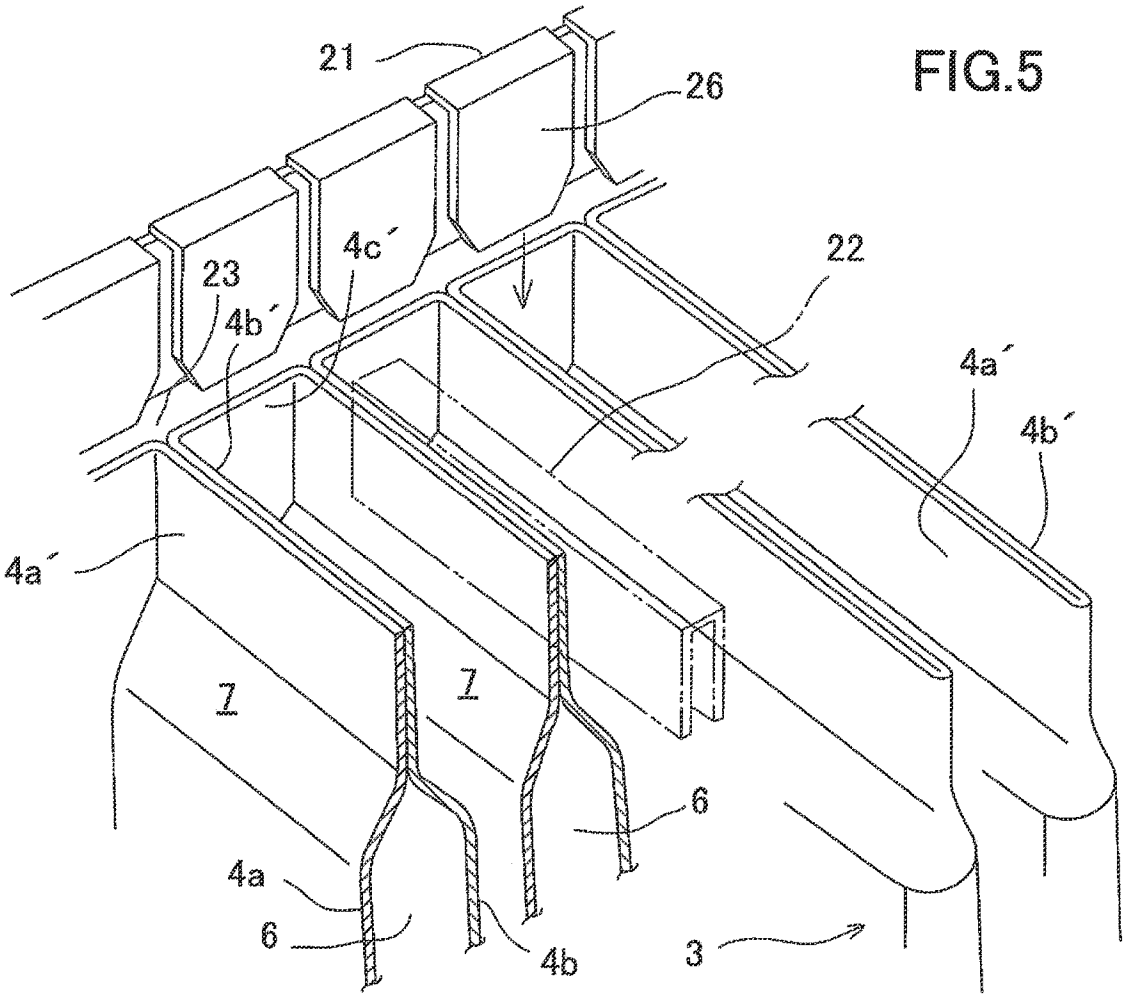
FIG. 5 is a partial perspective view of an air-tight structure of end portions of the heat transfer unit.

In case both end portions of the flat plates 4*a* and 4*b* are crushed as FIG. 5 shows, the flow passage (the first flow passage 6 in the figure) is closed at one end, and a free end is formed at the point where the flat plates 4*a* and 4*b* are folded back, while the flow passage (the second flow passage 7 in the figure) is spread out. Because the second flow passage 7 is spread out on this other end, the folded-back portion of the flat plate 4, which forms the second flow passage 7, is turned to a rectangular form by an end portion 4*a*', an end portion 4*c*' and an end portion 4*b*'. Also, a groove 23 is formed along a junction line of both end portions 4*a*' and 4*b*' being adhered. Because the groove 23 is communicated with the first flow passage 6, the groove 23 must be closed.

On the other end of the heat transfer unit 3, the edge sealing hardware 21 of comb-shaped type is inserted, and the edge sealing hardware 21 is welded together with edge of the heat transfer unit 3, and the other end of the heat transfer unit 3 is sealed.

The ridge-line sealing hardware 22 is inserted over the total length of both of the end portions 4*a*' and 4*b*' of the flat plates 4*a* and 4*b*, and the ridge-line sealing hardware 22 and edges of the both end portions 4*a*' and 4*b*' are welded over total length.

Referring to FIG. 6, description will be given on the edge sealing hardware 21.

Claw pieces 26 in comb-like shape are formed on a metal plate 25 in form of band plate. A bending groove 27 is formed over total length of the metal plate 25 adjacent to a base end of each of the claw pieces 26. For cutting the claw pieces 26, press working process or laser beam cutting etc. as required are used. Or, the bending groove 27 is machined by a processing machine as required such as a mailing machine.

Figure 6A:
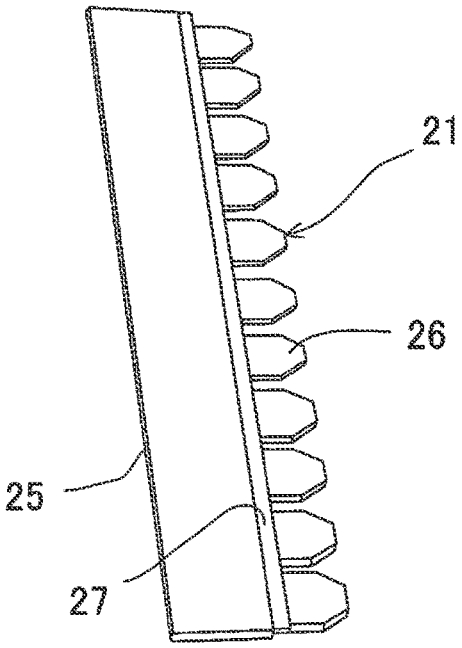
FIG. 6A, FIG. 6B, FIG. 6C, FIG. 6D and FIG. 6E each represents a drawing to explain an edge sealing hardware to be used in the air-tight structure.
Figure 6B:
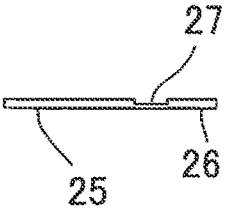
Figure 6C:
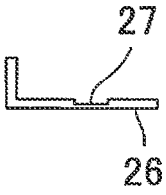
Figure 6D:
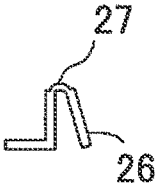
Figure 6E:
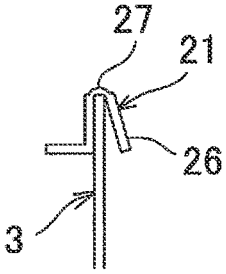
Figure 7A:
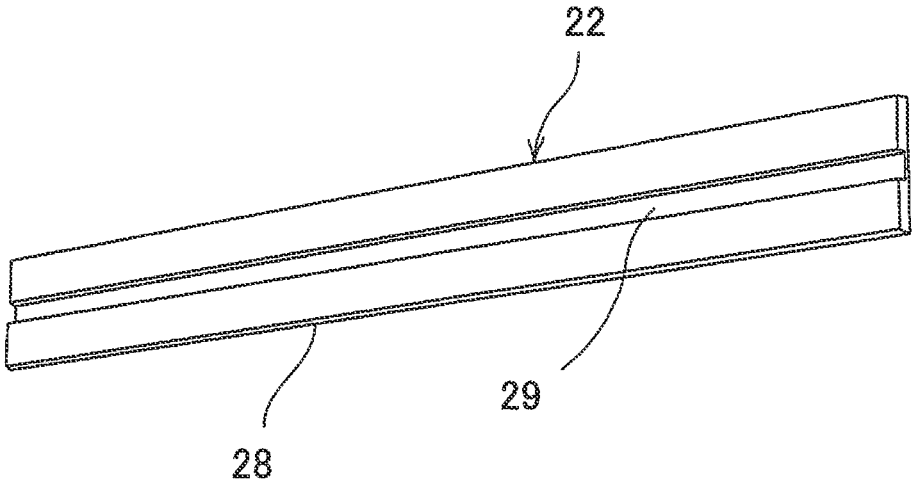
FIG. 7A, FIG. 7B, FIG. 7C and FIG. 7D each represents a drawing to explain a ridge-line sealing hardware to be used in the air-tight structure.
Figure 7B:
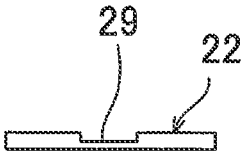
Figure 7C:
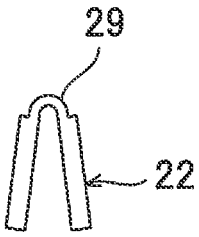
Figure 7D:
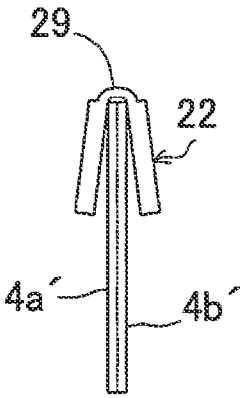

A flat plate part of the metal plate 25 is bent at right angle (FIG. 6C), and further is folded back in a direction reverse to the flat plate part (folded back at an angle of approx. 180°) (FIG. 6D).

The edge sealing hardware 21 is attached on the other end of the heat transfer unit 3.

The claw piece 26 is inserted into the enlarged second flow passage 7. Width of the claw piece 26 is set to be equal to an inner dimension of the enlarged second flow passage 7, and a pitch of the claw piece 26 is set to be equal to the pitch of the first flow passage 6 and the second flow passage 7. Therefore, under the condition that the claw piece 26 is inserted into the second flow passage 7, both end portions 4*a*' and 4*b*' are adhered to each other.

Under the condition where the edge sealing hardware 21 is attached, the bending groove 27 is molten, and the edge sealing hardware 21 and the heat transfer unit 3 are welded together. As welding method, a laser welding is preferably used because it is possible to perform welding without distortion and with high accuracy and with deeper sufficient welding depth.

It is to be noted that the edge sealing hardware 21 suppresses the springing-back after the processing of the heat transfer unit 3 and maintains both of the end portions 4*a*' and 4*h*' in an adhering condition, and the edge sealing hardware 21 can fulfill the function as a jig for welding process.

When the edge sealing hardware 21 is welded, the groove 23 is also completely sealed, and the first flow passage 6 is kept in completely separated condition.

Next, by referring to FIG. 7, description will be given on the ridge-line sealing hardware 22.

The ridge-line sealing hardware 22 consists of a metal band plate 28 where a bending groove 29 is formed over total length. The bending groove 29 is machined by a milling machine, for instance.

The ridge-line sealing hardware 22 is bent and folded by twice-folding process (FIG. 7C), and the ridge-line sealing hardware 22 is attached to both end portions 4*a*' and 4*b*' so that the both end portions 4*a*' and 4*b*' are sandwiched under the folded condition. Further, the bending groove 29 is welded, and the ridge-line sealing hardware 22 is welded on both end portions 4*a*' and 4*b*'. Also, it is preferable that laser welding is used for the welding of the ridge-line sealing hardware 22. In this case also, it is needless to say that the ridge-line sealing hardware 22 fulfills the function as a jig for welding to maintain both of the end portions 4*a*' and 4*b*' in an adhering condition.

Figure 8:
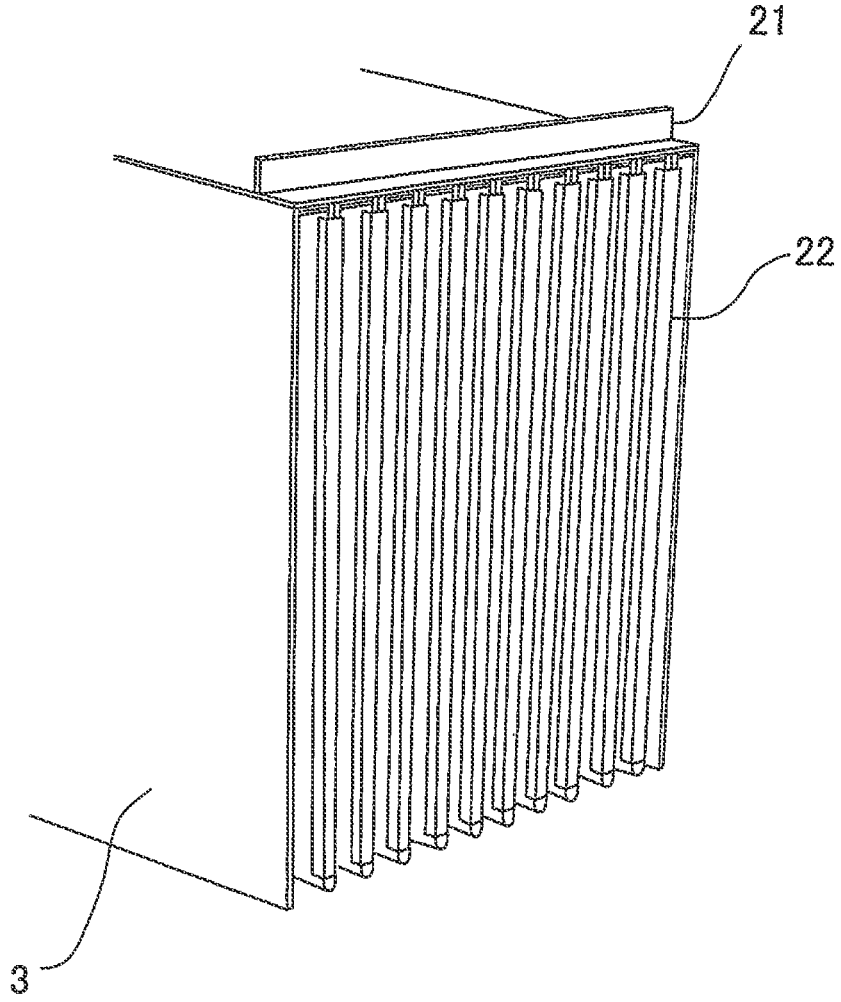
FIG. 8 is a partial perspective view to show a condition where the edge sealing hardware and the ridge-line sealing hardware are mounted on an end portion of the heat transfer unit.

FIG. 8 shows the condition where the edge sealing hardware 21 and the ridge-line sealing hardware 22 are welded on the end portions of the heat transfer unit 3.

When end portion of the heat transfer unit 3 is welded via the edge sealing hardware 21 and the ridge-line sealing hardware 22, the first flow passage 6 and the second flow passage 7 are completely separated from each other. Further, the first flow passage 6 and the second flow passage 7 are separated from each other in de heat transfer unit 3 itself, and assembling of the heat transfer unit 3 into the casing 2 can be easily carried out.

Further, because separation of the first flow passage 6 and the second flow passage 7 can be perfectly carried out by welding, heat exchange can be executed even when one of the fluids is a liquid and the other is a gas or even when two fluids should not be mixed together, it becomes possible to heat-exchange between the two fluids. This contributes to the improvement of safety.

It is to be noted that there is another method to use the heat exchanger 1 of the present embodiment. In FIG. 1, a first opening 9 and a second opening 10 on front wall surface 13 are closed. A first opening is provided on a right lateral plate 18, and a second opening is provided on a left lateral plate 19. Then, it may so arranged that a first fluid, e.g. high temperature fluid 16, is flown from the first opening on the right lateral plate 18 toward the second opening of the left lateral plate 19.

According to the present embodiment, it is possible to change the position of the opening arranged on the casing 2, and also, to change direction of the fluid to be processed by the heat exchange, and this makes it possible to relieve the restriction on the installation of the heat exchanger 1.

Next, by referring to FIG. 9 and FIG. 10, description will be given below on another embodiment.

Figure 9:
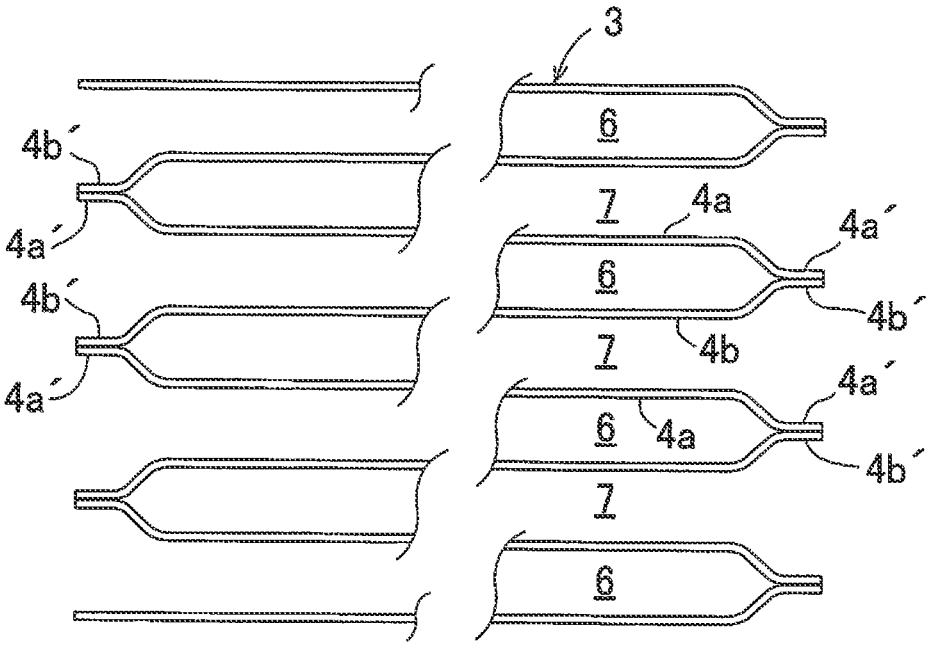
FIG. 9 shows a cross-section of a heat transfer unit according to another embodiment of the invention, and is an equivalent arrow diagram along the line B-B in FIG. 3.

FIG. 9 shows a heat transfer unit 3. In the heat transfer unit 3 as shown in FIG. 4, both end portions of the same flow passage (one of either a first flow passage 6 or a second flow passage 7, the first flow passage 6 in the figure) are crushed and are closed air-tightly.

On the other hand, in the heat transfer unit 3 shown in FIG. 9, each layer of the multi-layered flow passage—that is, a first flow passage 6 and the second flow passage 7—is alternately crushed by each of the layers, and a position, as crushed, is changed, one end to the other end, by each of the layers. Thereby, one end of the first flow passage 6 and one end of the second flow passage 7 are adhered to each other and are air-tightly sealed.

The adhering position is changed for each of the layers. As a result, an area for heat transfer between the first flow passage 6 and the second flow passage 7 is increased, and a thermal efficiency is improved.

Figure 10:
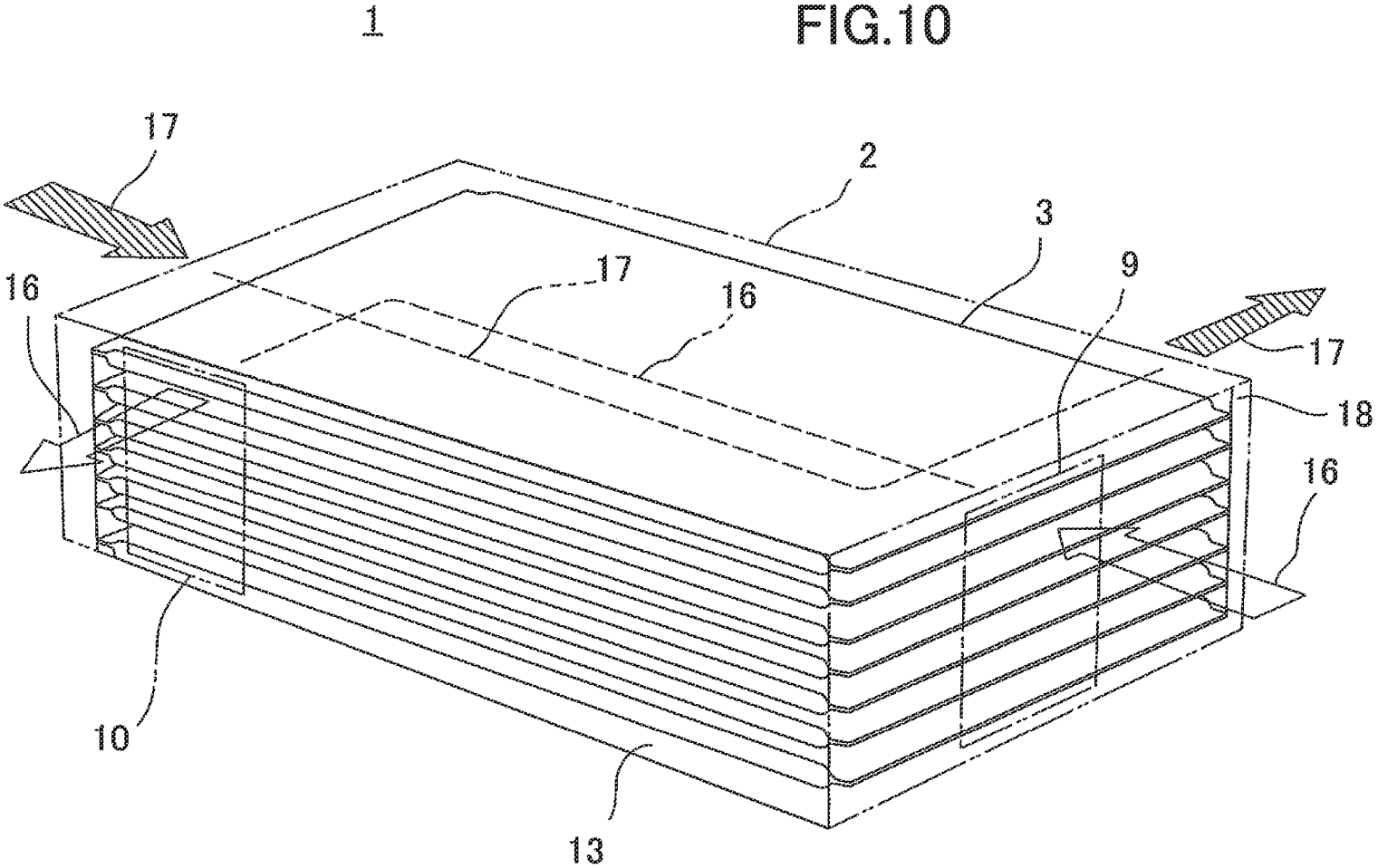
FIG. 10 is an explanatory drawing to show a flowing condition where the heat transfer unit is accommodated in a casing and a condition of flowing of the fluid to be processed by heat exchange.

FIG. 10 shows a heat exchanger 1 where the heat transfer unit 3 is accommodated in a casing 2.

As described above, in the heat transfer unit 3, by changing the adhering positions for each layer, the first flow passage 6 and the second flow passage 7 can be separated at both end portions of the heat transfer unit 3. As a result, it can be so arranged that the fluid for heat exchange can be brought in from lateral direction and can be flown out from the front side or the rear side.

For instance, as shown in FIG. 10, a first opening 9 is formed on a right lateral plate 18 of the casing 2 and a second opening 10 is formed or the front wall surface 13. A high temperature fluid 16 is flown in via the first opening 9 and is flown out via the second opening 10.

Although not shown in the figure, a third opening is formed on a left lateral plate of the casing 2, and a fourth opening is formed on a rear wall surface. A low temperature fluid 17 is flown in via the third opening and is flown out via the fourth opening. It is needless to say that the same flow passage arrangement as shown in FIG. 1 is adopted in this other embodiment.

According to this embodiment, a heat transfer area of the heat transfer unit 3 is increased and the arrangement of the flow passage can be varied. As a result, it is possible to increase thermal efficiency, to change position of the opening to be provided on the casing 2, also to change a direction of the fluid, for which heat exchange is to be performed, and further to relieve the restriction on the installation of the heat exchanger 1.

The invention claimed is:

1. A heat exchanger, comprising a casing with a structure of a hollow box and a heat transfer unit accommodated in the casing, wherein said heat transfer unit comprises a plate that is alternately folded back in opposite directions along fold-back lines to define a plurality of flat plates, wherein the plurality of flat plates define alternate first flow passages and second flow passages, a first opening and a second opening communicating with said first flow passage are provided on said casing, a third opening and a fourth opening communicating with said second flow passage are provided on said casing, wherein respective flanges of adjacent flat plates of the plurality of flat plates are in contact with each other to seal opposite ends of the first flow passage and the second flow passage, wherein said heat exchanger further comprises edge sealing hardware and ridge-line sealing hardware, wherein said edge sealing hardware comprises a metal plate having a plurality of claw pieces, where each claw piece is inserted into a respective second flow passage and attaches to respective end portions of the plurality of flat plates, where a width of each claw piece is equal to a distance between two flat plates of the plurality of flat plates that defines a respective second flow passage, and where a pitch of the claw pieces is set to be equal to a pitch of the first flow passages and the second flow passages such that the edge sealing hardware has a comb shape, a bending groove is formed over total length of said metal plate adjacent to a base end of each of said claw pieces and said claw pieces are folded at said bending groove, said ridge-line sealing hardware comprises a plurality of ridge-line sealing plates that cover the flanges of respective adjacent flat plates of the plurality of flat plates, wherein a groove is formed on each ridge-line sealing plate and each ridge-line sealing plate is folded at the groove, the respective flanges of adjacent flat plates of the plurality of flat plates are each located between two adjacent claw pieces of said edge sealing hardware and each ridge-line sealing plate is respectively positioned over a length of the respective flanges of said adjacent flat plates of the plurality of flat plates, the respective edges of said end portions of said flat plates of the plurality of flat plates are welded to the groove of said edge sealing hardware by laser welding, the respective flanges of said adjacent flat plates of the plurality of flat plates are welded to the groove of a respective ridge-line sealing plate by laser welding.

* * * * *